US009024820B2

(12) United States Patent
Chou

(10) Patent No.: US 9,024,820 B2
(45) Date of Patent: May 5, 2015

(54) MINIATURE ANTENNA

(75) Inventor: Chih-Shen Chou, Miaoli County (TW)

(73) Assignee: Unictron Technologies Corp., Hsin-Chu (TW)

( * ) Notice: Subject to any disclaimer, the term of this patent is extended or adjusted under 35 U.S.C. 154(b) by 533 days.

(21) Appl. No.: 13/481,641

(22) Filed: May 25, 2012

(65) Prior Publication Data

US 2012/0299782 A1 Nov. 29, 2012

(30) Foreign Application Priority Data

May 27, 2011 (TW) ..... 100209516 U

(51) Int. Cl.
*H01Q 1/38* (2006.01)
*H01Q 5/00* (2006.01)
*H01Q 9/04* (2006.01)

(52) U.S. Cl.
CPC ..... *H01Q 5/0072* (2013.01); *H01Q 9/0421* (2013.01)

(58) Field of Classification Search
CPC ..... H01Q 9/0421; H01Q 1/38
USPC ..... 343/700 MS
See application file for complete search history.

(56) References Cited

U.S. PATENT DOCUMENTS

| | | | | |
|---|---|---|---|---|
| 4,131,893 | A * | 12/1978 | Munson et al. | 343/700 MS |
| 5,561,435 | A * | 10/1996 | Nalbandian et al. | 343/700 MS |
| 6,639,558 | B2 * | 10/2003 | Kellerman et al. | 343/700 MS |
| 6,795,021 | B2 * | 9/2004 | Ngai et al. | 343/700 MS |
| 2007/0026567 | A1 * | 2/2007 | Beer et al. | 438/106 |

* cited by examiner

*Primary Examiner* — Dameon E Levi
*Assistant Examiner* — Hasan Islam
(74) *Attorney, Agent, or Firm* — Muncy, Geissler, Olds & Lowe, P.C.

(57) ABSTRACT

The present invention is related to a miniature antenna, mainly comprising a dielectric element, at least one first conductive plane, a second conductive plane, a third conductive plane, a plurality of ground terminals, and a signal feeding terminal. A part of the first conductive plane overlaps a part of the second conductive plane to form a first overlap region. A part of the first conductive plane also overlaps a part of the third conductive plane to form a second overlap region. Two resonant frequencies thus can be provided for the miniature antenna. By adjusting the sizes of overlap regions, the distances between the conductive planes, or dielectric constant of the dielectric element, the bandwidths of the two resonant frequencies may be produced to overlap each other to form a miniature antenna having a wider bandwidth.

40 Claims, 17 Drawing Sheets

MINIATURE ANTENNA

FIELD OF THE INVENTION

The present invention is related to a miniature antenna having a wider bandwidth obtained mainly by the adjustment of the size of each overlap regions, the distance or spacing between each of conductive planes or the dielectric constant of the dielectric element of the miniature antenna. Therefore plurality of resonant frequency bands can be formed and a wider bandwidth antenna can be obtained by adjusting the range of resonant frequency bands.

BACKGROUND

As the wireless communication technology become more and more popular, most of portable electronic devices are generally provided with the function of wireless communication. For instance, users are able to transmit and receive wireless data via mobile devices, such as mobile phones, smart phones, notebooks, personal digital assistants (PDAs), global positioning system (GPS), etc.

An antenna provided in a portable electronic device is mainly used for transmitting or receiving electromagnetic waves. Then, wireless information transmission/receiving is obtained through the propagation of electromagnetic waves in air. The quality of wireless communication is affected by the characteristics of the antenna, such as the resonant frequency (operating frequency) and bandwidth of the antenna, during the use of the antenna.

For the reduction of the volume and weight of the portable electronic device, circuit designers like to integrate antenna inside the portable electronic devices, such as the implementation of the planar F antenna on the printed circuit board. When the antenna is provided on the printed circuit board, it is usually necessary to further provide a clearance region between the antenna and other circuits on the printed circuit board. A clearance region is an area on the circuit board that has no electrical components and no circuit traces printed. This clearance is necessary to avoid the resonant frequency of the antenna being affected by having circuits too close to it. However, due to limited available circuit board area in most compact portable devices, it is quite difficult to print an antenna directly on printed circuit board. The advancement of chip antenna technology makes it a useful compact antenna solution for portable devices. However, the limited bandwidth of most chip antennas becomes a major drawback of it. The major objective of the present invention is to provide a chip antenna for achieving wider bandwidth and easy adjustability while being easily fabricated at a low cost. The antenna characteristics can be easily adjusted and a wider bandwidth can be also obtained to satisfy the need of compact portable devices.

SUMMARY OF THE INVENTION

One of the major objectives of the present invention is to provide a miniature dual band antenna, mainly provided with at least one first conductive plane on a first surface of a dielectric element, as well as at least a second conductive plane and at least a third conductive plane on a second surface of the dielectric element. A first overlap region is presented between the first conductive plane and the second conductive plane, while a second overlap region is presented between the first conductive plane and the third conductive plane, in such a way that the miniature antenna is formed as a dual-frequency antenna having a first resonant frequency and a second resonant frequency.

Another objective of the present invention is to provide a miniature dual band antenna having a first resonant frequency and a second resonant frequency, wherein the resonant frequencies can be easily adjusted by the modification of antenna structure and material properties. The first resonant frequency is positively correlated with the distance between the first conductive plane and the second conductive plane, the reciprocal of the area of the first overlap region and the reciprocal of dielectric constant of the dielectric element. The second resonant frequency is positively correlated with the distance between the first conductive plane and the third conductive plane, the reciprocal of the area of the second overlap region and the reciprocal of the dielectric constant of the dielectric element, It is a further objective of the present invention to provide a miniature antenna with a wider bandwidth. A part of the bandwidth of the first resonant frequency is able to overlap that of the second resonant frequency by means of adjustment of the distance between conductive planes, the area of each overlap regions and/or dielectric constant of the dielectric element of the miniature antenna, thus forming a miniature antenna with a wider bandwidth.

A further objective of the present invention is to provide a miniature antenna which may be integrated into a printed circuit board, and the substrate material or substrate of the printed circuit board may be thus used as the dielectric element of the miniature antenna. Therefore, the miniature antenna can be established during the fabrication process of the printed circuit board. By doing this, the fabrication procedures and the production cost can be significantly reduced.

To achieve these and the other objectives of the present invention, the present invention provides a miniature antenna, comprising: a dielectric element comprising a first surface and a second surface; at least one first conductive planes provided on the first surface of the dielectric element; at least one second conductive plane provided on a part of the second surface of the dielectric element, wherein a part of the second conductive plane overlaps a part of the first conductive plane, so as to form a first overlap region; at least one third conductive plane provided on a part of the second surface of the dielectric element, wherein a part of the third conductive plane overlaps a part of the first conductive plane, so as to form a second overlap region; a plurality of ground terminals connected with the first conductive plane, and the third conductive plane, respectively; and a signal feeding terminal connected with the second conductive plane.

In the aforesaid miniature antenna, it comprises two resonant frequencies, which are a first resonant frequency and a second resonant frequency, respectively. By the adjustment of the antenna parameters, the overlapping of the bandwidths of the first resonant frequency and second resonant frequency can be achieved and a wider bandwidth antenna can be obtained.

The aforesaid miniature antenna can also be implemented within a printed circuit board, wherein the substrate material or substrate of the printed circuit board is used as the dielectric element of the miniature antenna.

The aforesaid miniature antenna can further comprise a floating plane, which is a conductive plane not connected to a signal feeding terminal or ground terminal, wherein the floating plane is provided between the second conductive plane and the third conductive plane on the second surface, and overlaps a part of the first conductive plane.

To achieve these and other objectives of the present invention, the present invention also provides a miniature antenna, wherein the dielectric element of the miniature antenna comprises a plurality of dielectric layers stacked on top of one another; one or more first conductive planes provided between any two adjacent dielectric layers of the dielectric element or on the surface of any one of the dielectric layers; one or more second conductive planes provided between any two adjacent dielectric layers of the dielectric elements or on the surface of any one of the dielectric layers; one or more third conductive planes provided between any two adjacent dielectric layers of the dielectric elements or on the surface of any one of the dielectric layers; a plurality of ground terminals connected with the first conductive plane, and the third conductive plane, respectively; and a signal feeding terminal connected with the second conductive plane, wherein a part of the first conductive planes overlaps a part of the second conductive planes, so as to form one or more first overlap regions, while a part of the first conductive planes overlaps a part of the third conductive planes, so as to form one or more second overlap regions.

DETAILED DESCRIPTION

Figure 1:
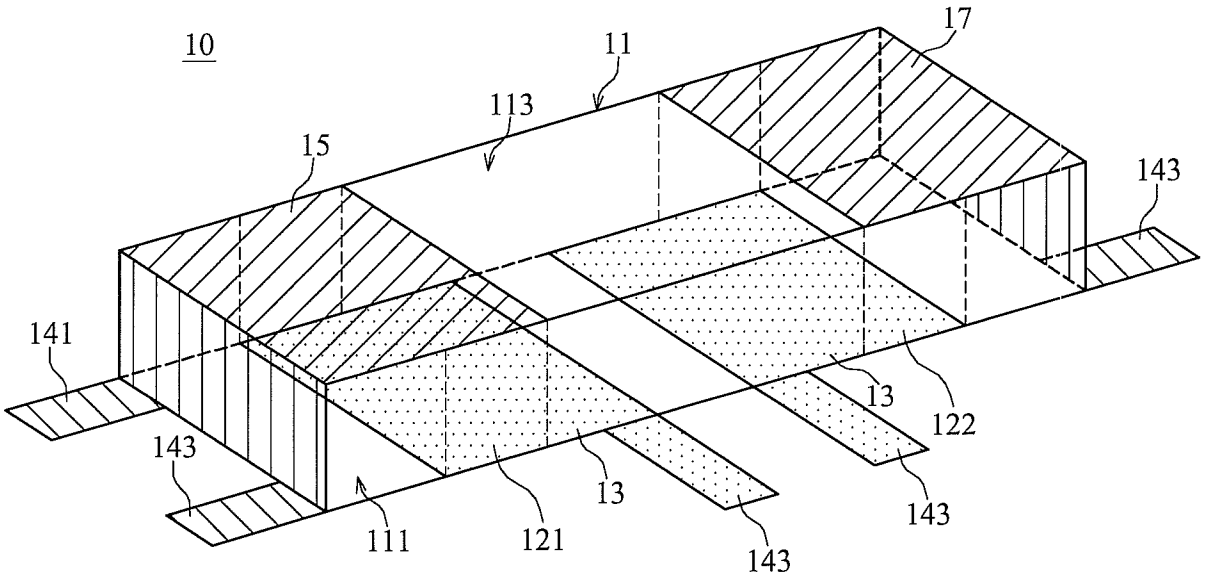
FIG. 1 is a perspective diagram of a miniature antenna according to one embodiment of the present invention.

Referring to FIG. 1, there is shown a perspective diagram of a miniature antenna according to one embodiment of the present invention. As illustrated in this figure, a miniature antenna 10 mainly comprises a dielectric element 11, at least one first conductive plane 13, a second conductive plane 15 and a third conductive plane 17, the dielectric element 11 comprising a first surface 111 and a second surface 113. For instance, the first surface 111 is opposite to the second surface 113, with the first surface 111 being used as a bottom surface, while the second surface 113 being as a top surface. On a part of the first surface 111 of the dielectric element 11, there are provided with one or more first conductive planes 13, such as two first conductive planes 13. Moreover, on a part of the second surface 113 of the dielectric element 11, there are provided with a second conductive plane 15 and a third conductive plane 17.

In the present invention, the first conductive plane 13, the second conductive plane 15 and the third conductive plane 17 are made of electrically conductive material, such as metallic material. Moreover, the first conductive plane 13, the second conductive plane 15 and the third conductive plane 17 are two-dimensional planar planes.

Figure 1A:
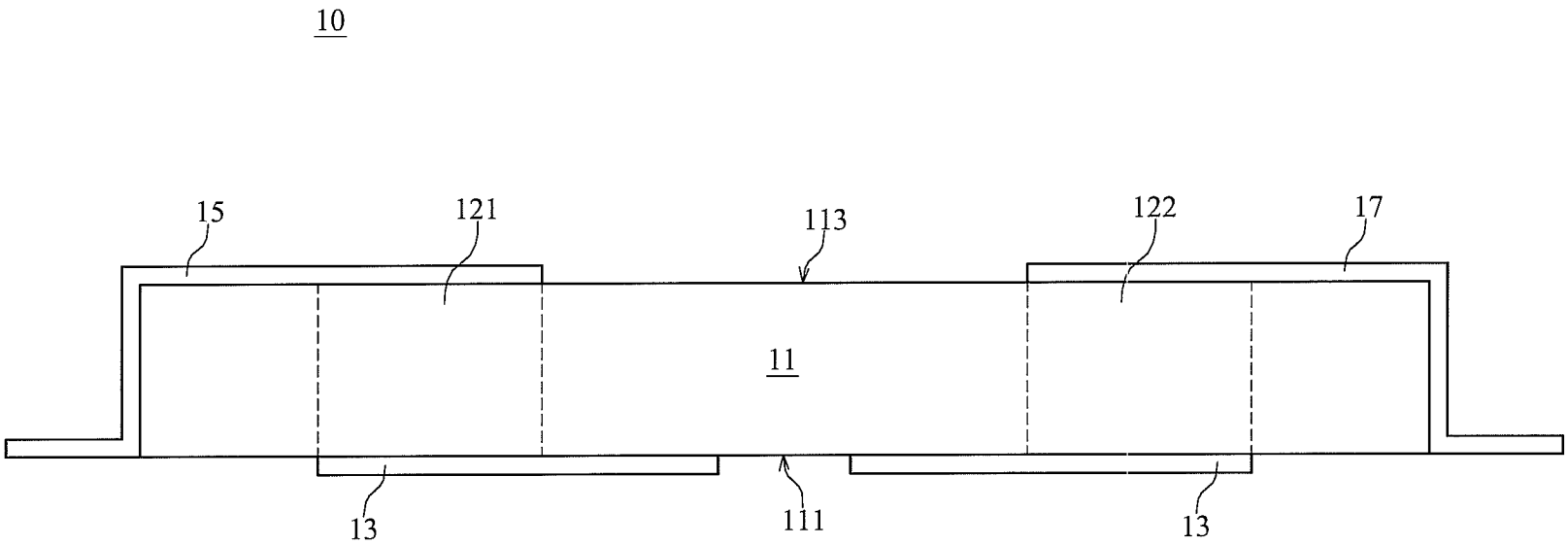
FIG. 1A is a side view of the miniature antenna shown in FIG. 1 of the present invention.

In certain embodiments, the dielectric element 11 is made of insulating or magnetic materials, and used for isolating the first conductive plane 13, the second conductive plane 15 and the third conductive plane 17 with one another. Referring to FIG. 1A cooperatively, a part of the first conductive plane 13 overlaps a part of the second conductive plane 15, so as to form a first overlap region 121. Moreover, a part of the first conductive plane 13 overlaps a part of the third conductive plane 17, so as to form a second overlap region 122.

A first capacitance C1 is formed by the first overlap region 121 between the first conductive plane 13 and the second conductive plane 15, while a second capacitance C2 is formed by the second overlap region 122 between the first conductive plane 13 and the third conductive plane 17. The miniature antenna 10 is then established with two different resonant frequencies.

Figure 2:
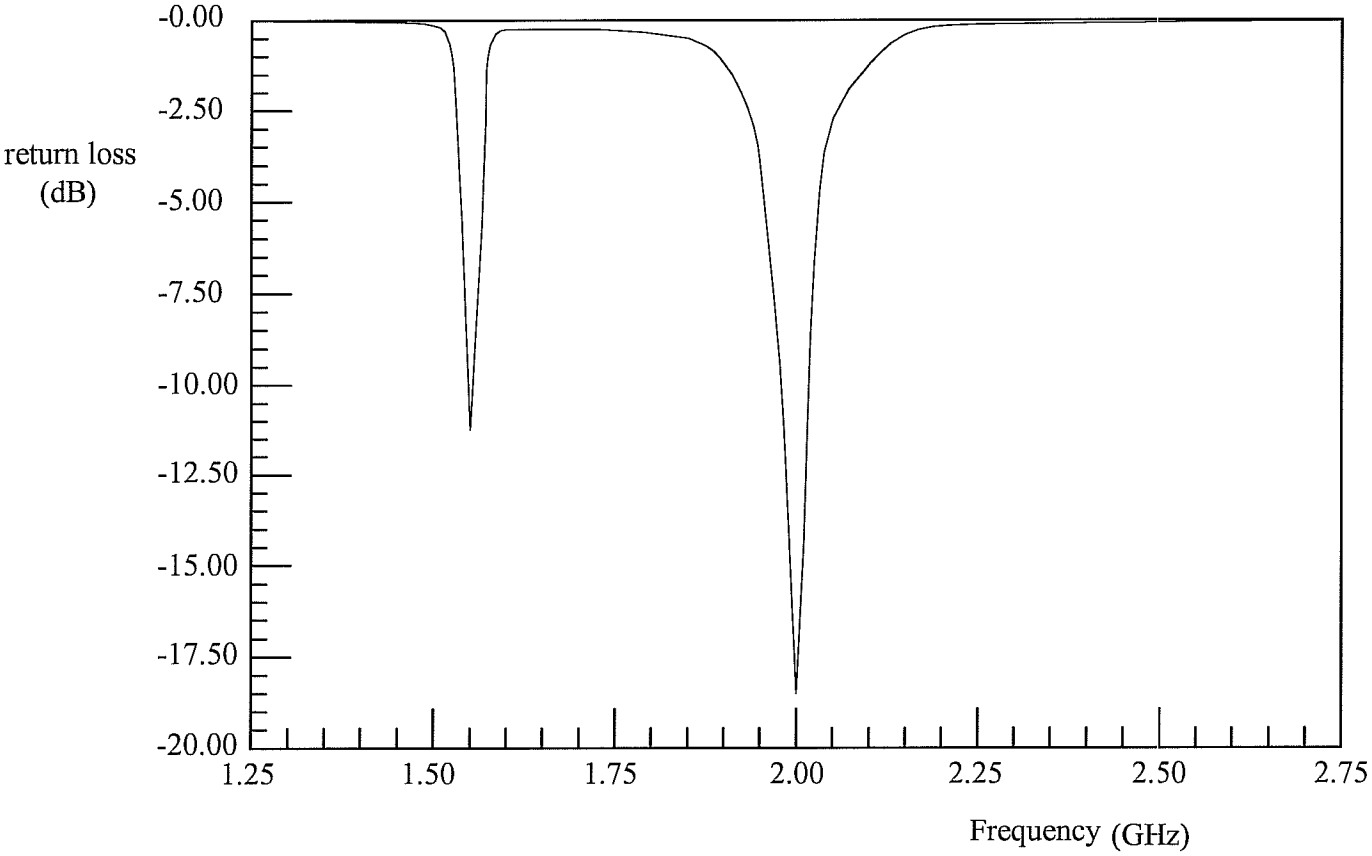
FIG. 2 is a diagram of return loss versus frequency of a miniature antenna according to one embodiment of the present invention.

In one embodiment of the present invention, the resonant frequencies of the miniature antenna 10 are shown in FIG. 2. The miniature antenna 10 comprises at least two resonant frequencies, and the resonant frequencies can be tuned or adjusted by modifying the antenna structure of the miniature antenna 10. For example, a first resonant frequency f1 of the miniature antenna 10 is approximately located at 1.55 GHz, while a second resonant frequency f2 of the miniature antenna 10 is approximately located at 1.995 GHz. Therefore, data transmitting/receiving may be effected by the miniature antenna 10 within appropriate bandwidths of the first resonant frequency f1 and the second resonant frequency f2, respectively. In this embodiment, although two different resonant frequencies, such as the first resonant frequency f1 and the second resonant frequency f2, are provided for the miniature antenna 10, their bandwidths are not wider than the usual. Taking FIG. 2 as an example, the −10 dB bandwidth of the first resonant frequency f1 is approximately 0.0125 GHz, and the −10 dB bandwidth of the second resonant frequency f2 is approximately 0.05 GHz.

For the miniature antenna 10, the first resonant frequency f1 is positively correlated with respect to the distance between the first conductive plane 13 and the second conductive plane 15, the reciprocal of the area of the first overlap region 121 and the reciprocal of dielectric constant of the dielectric element 11. Moreover, the second resonant frequency f2 is positively correlated with respect to the distance between the first conductive plane 13 and the third conductive plane 17, the reciprocal of the area of the second overlap region 122 and the reciprocal of dielectric constant of the dielectric element 11.

In practical use, the first resonant frequency 11 and the second resonant frequency f2 of the miniature antenna 10 may be changed by means of the further adjustment of the distance between the first conductive plane 13 and the second conductive plane 15, the area of the first overlap region 121, the distance between the first conductive plane 13 and the third conductive plane 17, the area of the second overlap region 122 and dielectric constant of the dielectric element 11 of the miniature antenna 10.

Figure 3:
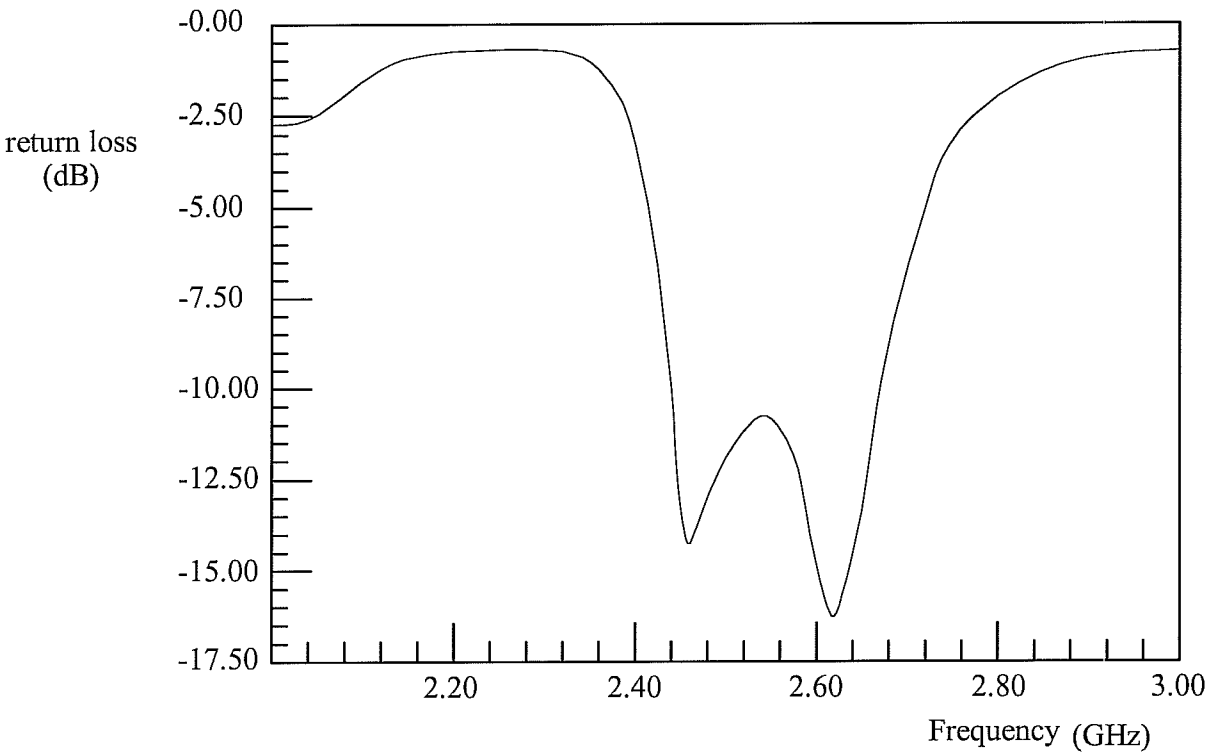
FIG. 3 is a diagram of return loss versus frequency of a miniature antenna according to a further embodiment of the present invention.

In another embodiment of the present invention, the value of the first resonant frequency f1 and the second resonant frequency f2 may be made closer to each other, in which, as shown in FIG. 3, a part of the bandwidth of the first resonant frequency f1 overlaps that of the second resonant frequency f2, and then a wider bandwidth is provided for the miniature antenna 10. Thereby, the applicable scope of the miniature antenna 10 may be increased. In this embodiment, for instance, the bandwidth of the miniature antenna 10 is approximately 0.25 GHz.

The second conductive plane 15 of the miniature antenna 10 may be provided on a part of the top surface of the dielectric element 11, and extended to one side surface of the dielectric element 11. Moreover, the third conductive plane 17 of the miniature antenna 10 may be provided on a part of the top surface of the dielectric element 11, and extended to the other side surface of the dielectric element 11. Moreover, the miniature antenna 10 further comprises a signal feeding terminal 141, connected with the second conductive plane 15, and a plurality of ground terminals 143, each respectively connected with the first conductive plane 13, the second conductive plane 15 and/or the third conductive plane 17. For example, the signal feeding terminal 141 is connected with the second conductive plane 15, and the ground terminals 143 are connected with the first conductive plane 13 and the third conductive plane 17.

In other embodiment, the miniature antenna 10 comprises a signal feeding terminal 141 connected with the first conductive plane 13, and a plurality of ground terminals 143 connected with the first conductive plane 13, the second conductive plane 15 and/or the third conductive plane 17. For example, the signal feeding terminal 141 is connected with the first conductive plane 13, and the ground terminals 143 are connected with the second conductive plane 15 and the third conductive plane 17.

Figure 4:
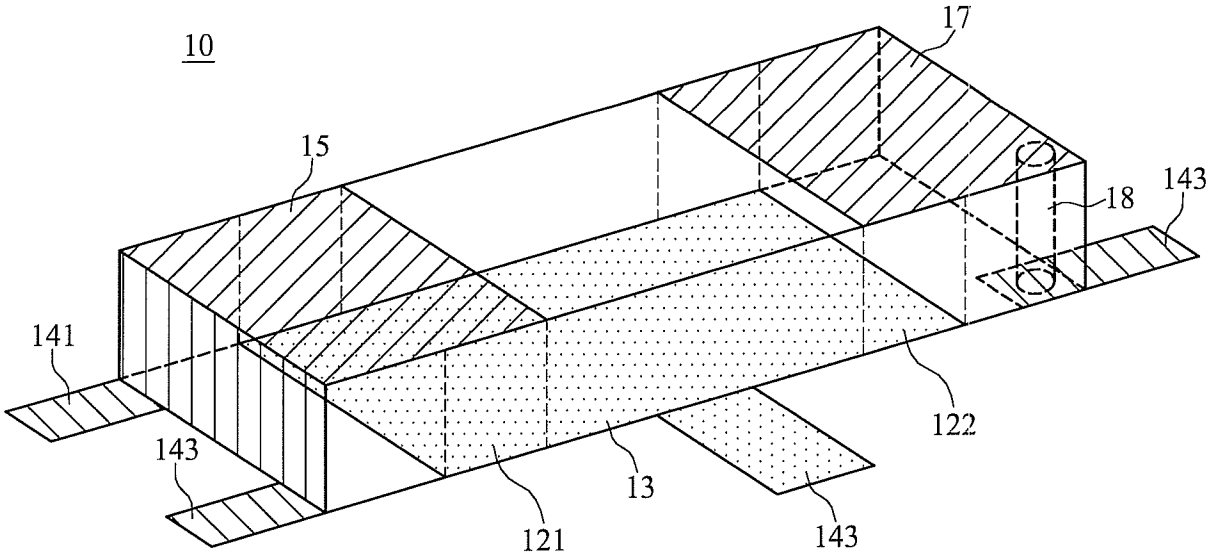
FIG. 4 is a perspective diagram of a miniature antenna according to an embodiment of the present invention.

In different embodiments, single one first conductive plane 13 may be provided for the miniature antenna 10. As illustrated in FIG. 4, two ends of the first conductive plane 13 may respectively overlap a part of the second conductive plane 15 and a part of the third conductive plane 17, and the first overlap region 121 and the second overlap region 122 may be then formed in the miniature antenna 10 similarly. The second conductive plane 15 is extendedly provided on the side surface of the dielectric element 11, and connected to the signal feeding terminal 141 and the ground terminal 143. Moreover, the third conductive plane 17 is connected to the ground terminal 143 via a connection unit 18 passing through the dielectric element 11. In different embodiments, certainly, the second conductive plane 15 may be also connected to the signal feeding terminal 141 and the ground terminal 143 via the connection unit 18.

Figure 4A:
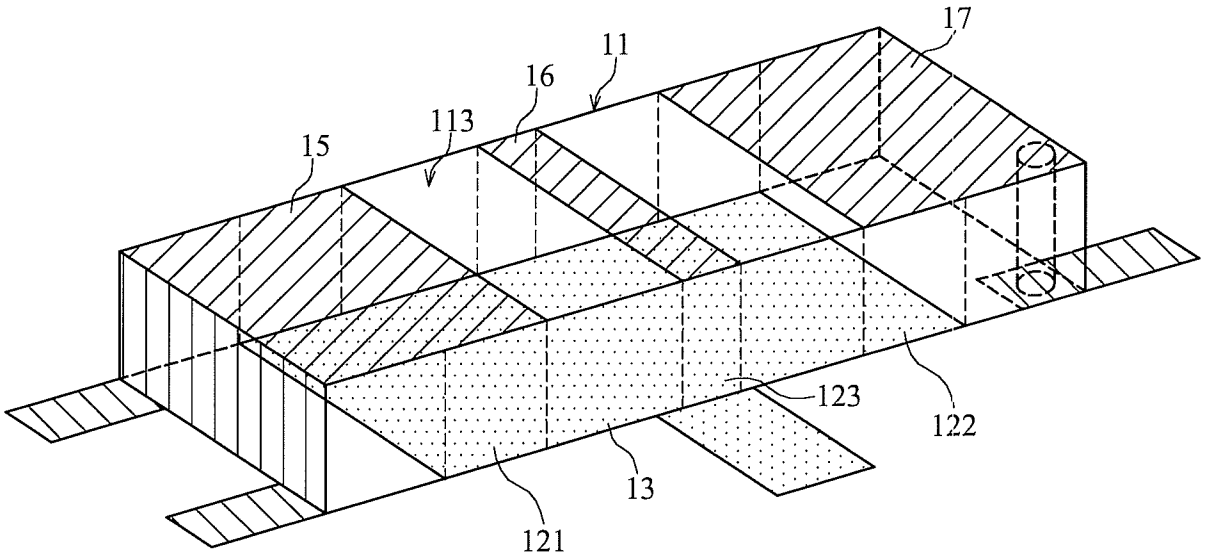
FIG. 4A is a perspective diagram of a miniature antenna according to a further embodiment of the present invention.

The miniature antenna 10 may also comprise a floating plane 16, which is a conductive plane. Moreover, the floating plane 16 does not connect to the signal feeding terminal 141 nor the ground terminal 143. As illustrated in FIG. 4A, the floating plane 16 may be provided on the second surface 113 of the dielectric element 11, and an overlap region 123 is then formed between the floating plane 16 and the first conductive plane 13. The floating plane 16 is located between the second conductive plane 15 and the third conductive plane 17, but not connected therewith. Moreover, neither the signal feeding terminal 141 nor the ground terminal 143 is connected with the floating plane 16.

Figure 5:
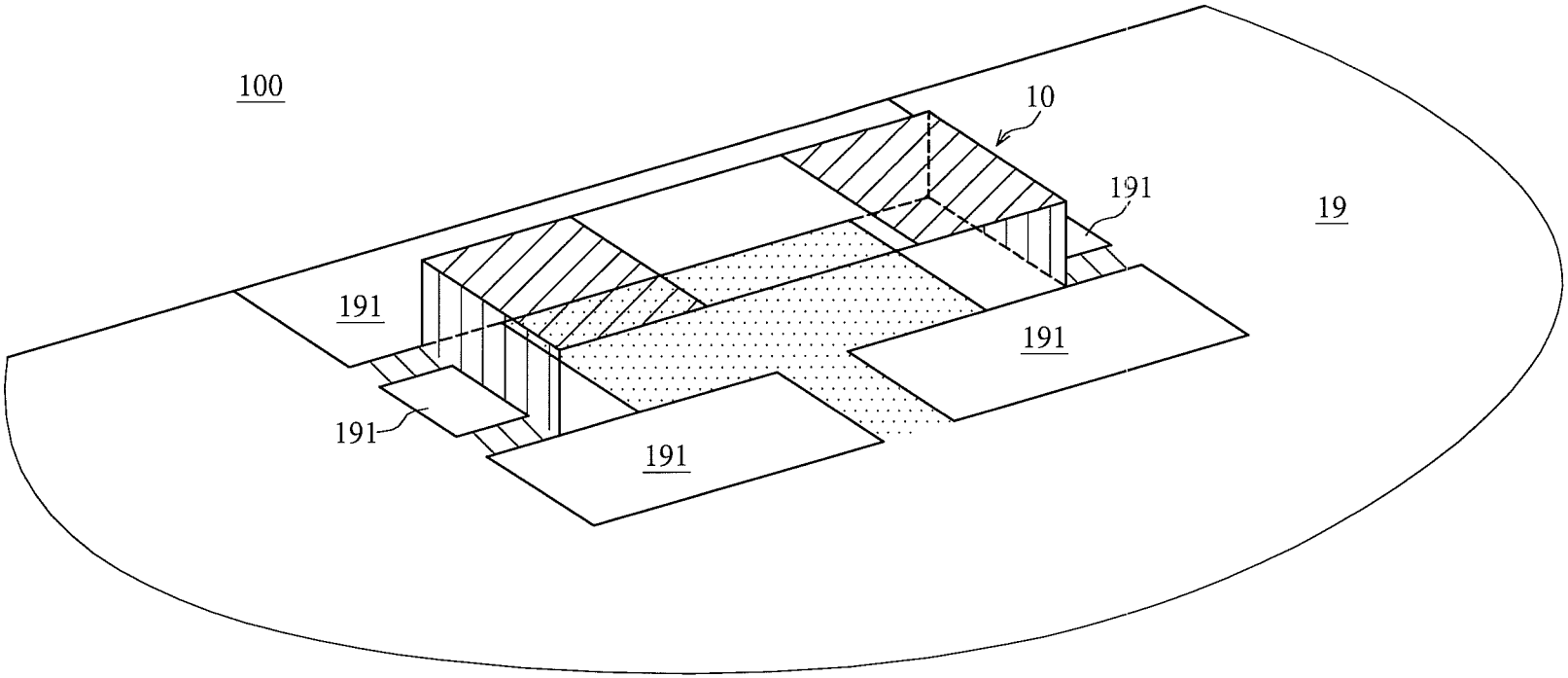
FIG. 5 is a perspective diagram of a miniature antenna device according to one embodiment of the present invention.

In practical use, the miniature antenna 10 may be installed on the surface of a circuit board 19, such as printed circuit board (PCB), for transmitting and receiving of wireless signals, so as to integrate the antenna 10 with the circuit board 19 to be a miniature antenna device 100. As illustrated in FIG. 5, the miniature antenna 10 is installed on the surface of the circuit board 19, and is provided with a clearance regions 191 around itself, wherein clearance regions 191 is regions with no electric circuitry or electrical components, so as to separate this antenna from other circuit elements on the circuit board.

Figure 6:
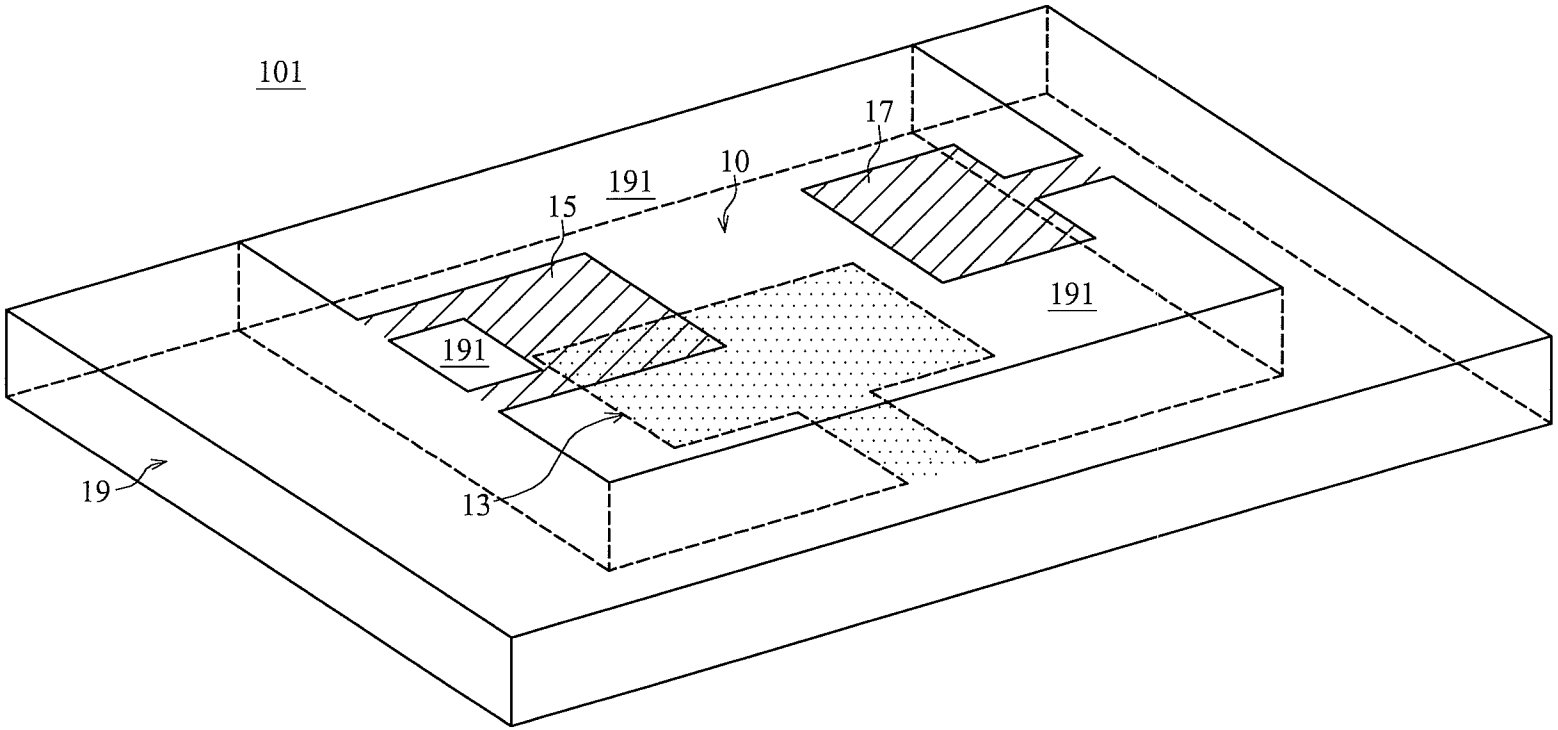
FIG. 6 is a perspective diagram of a miniature antenna device according to a further embodiment of the present invention.
Figure 6A:
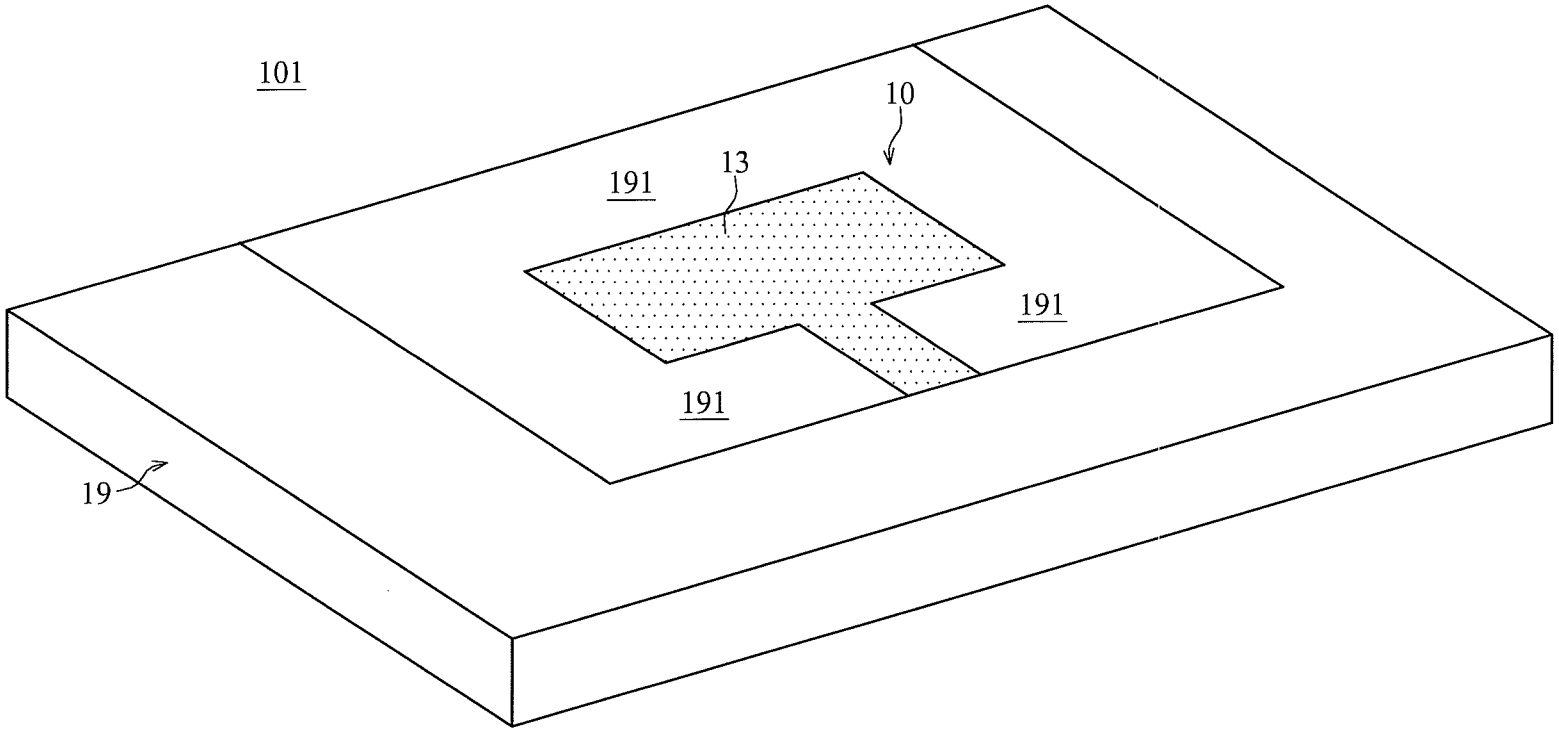
FIGS. 6A and 6B are respectively a bottom view and a top view of a miniature antenna device according to one embodiment of the present invention.
Figure 6B:
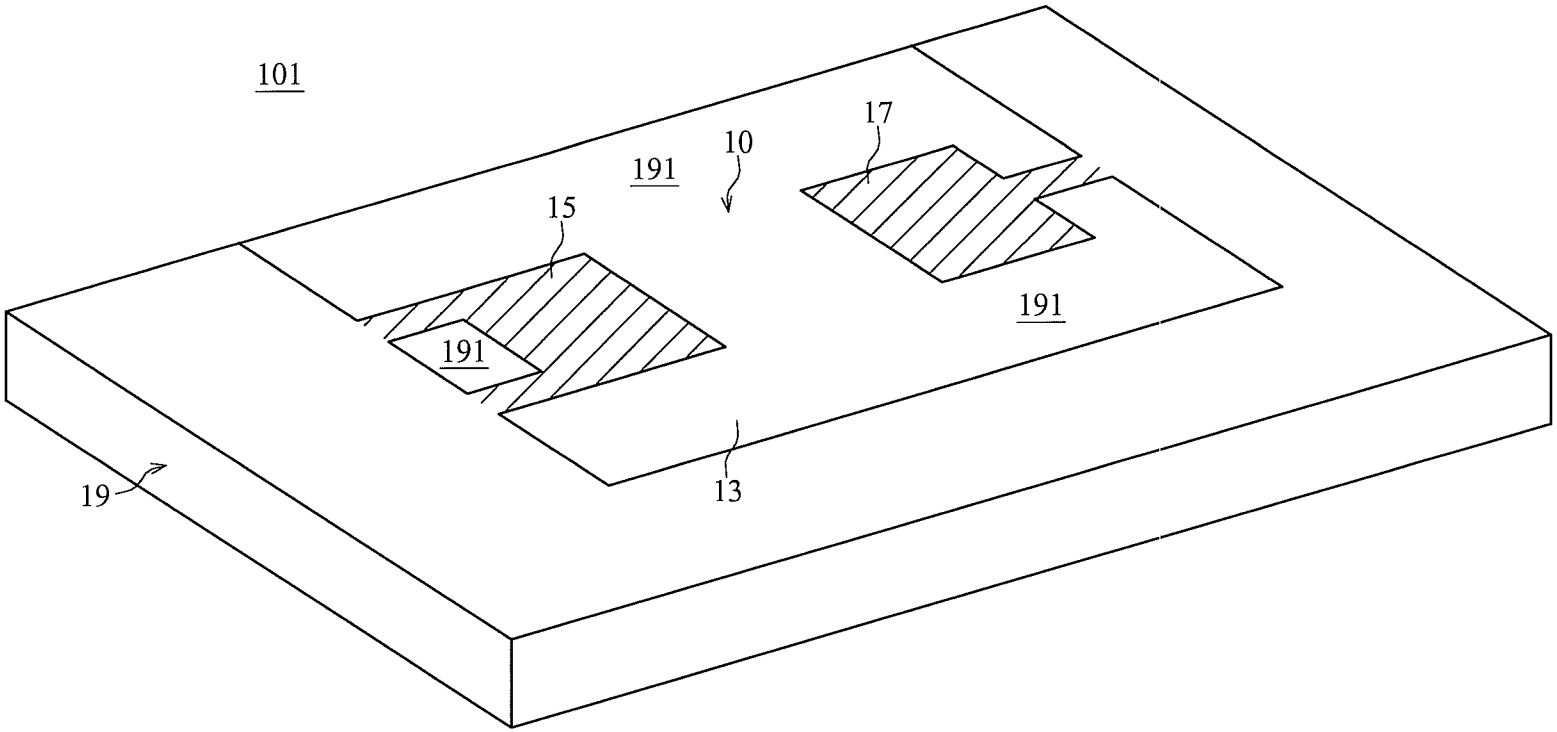

In different embodiments, as illustrated in FIG. 6, the miniature antenna 10 may be further integrated into the circuit board 19, such as printed circuit board (PCB). The miniature antenna 10 and the circuit board 19 are integrated to be a miniature antenna device 101, and the substrate or substrate material of the circuit board 19 is used as the dielectric element 11 of the miniature antenna 10. For example, the dielectric element 11 is part of the circuit board 19 with thickness equals or less than the circuit board 19. The first conductive plane 13 is provided on one surface of the substrate or substrate material of the circuit board 19, and the antenna 10 is provided with at least one clearance region 191 around itself, as illustrated in FIG. 6A. The second conductive plane 15 and the third conductive plane 17 are provided on the other surface of the substrate or substrate material of the circuit board 19, and the antenna 10 is provided with at least one clearance region 191 around itself, as illustrated in FIG. 6B. Thereby, the construction of the miniature antenna 10 may be integrated into the circuit board 19 when the circuit board is designed or manufactured, facilitating the simplification of the manufacturing process of the miniature antenna 10, and the reduction of volume of the miniature antenna 10.

Figure 7:
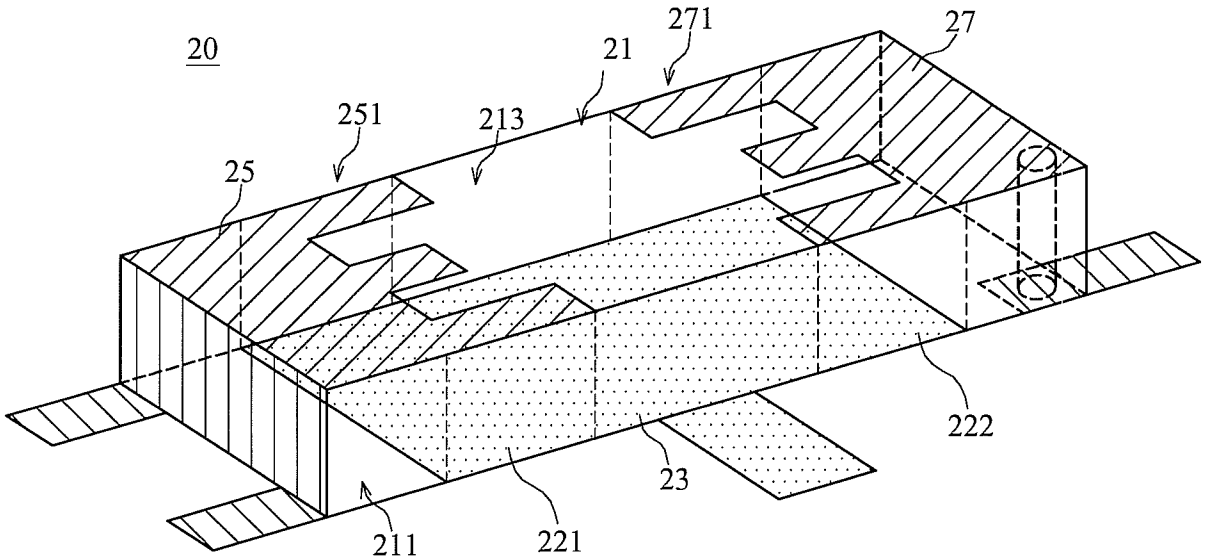
FIG. 7 is a perspective diagram of a miniature antenna according to a further embodiment of the present invention.

Referring to FIG. 7, there is shown a perspective diagram of a miniature antenna according to a further embodiment of the present invention. As illustrated in this figure, a miniature antenna 20 comprises a dielectric element 21, at least one first conductive plane 23, a second conductive plane 25 and a third conductive plane 27, the dielectric element 21 comprising a first surface 211 and a second surface 213. A part of the first surface 211 of the dielectric element 21 is provided with one or more first conductive planes 23, while a part of the second surface 213 of the dielectric element 21 is provided with a second conductive plane 25 and a third conductive plane 27. Furthermore, a part of the first conductive plane 23 overlaps a part of the second conductive plane 25 so as to form a first overlap region 221, and a part of the first conductive plane 23 overlaps a part of the third conductive plane 27, so as to form a second overlap region 222.

In the present embodiment, each of the second conductive plane 25 and the third conductive plane 27 is presented at one end thereof as an irregular shape. For instance, each of the second conductive plane 25 and the third conductive plane 27 is provided at one end thereof with at least one uneven part 251 and 271, respectively. In this embodiment, the uneven part 251/271 may also comprise at least one meandering pattern, such as zigzag pattern or serpentine pattern, or at least one protruding parts with different lengths.

The area of the first overlap region 221 and the second overlap region 222 may be finely tuned further, and the adjustment of the resonant frequencies of the miniature antenna 20 may be then achieved by the provision of the uneven part 251/271. In different embodiments, certainly, it is also allowable for only one of the second conductive plane 25 and the third conductive plane 27 to be shaped as a zigzag pattern. Furthermore, the first conductive plane 23 of the miniature antenna 20 may be also presented as zigzag-like uneven structure. Additionally, the first conductive plane 23, the second conductive plane 25 and the third conductive plane 27 of the miniature antenna 20 may be also presented as arbitrary geometries.

Figure 8:
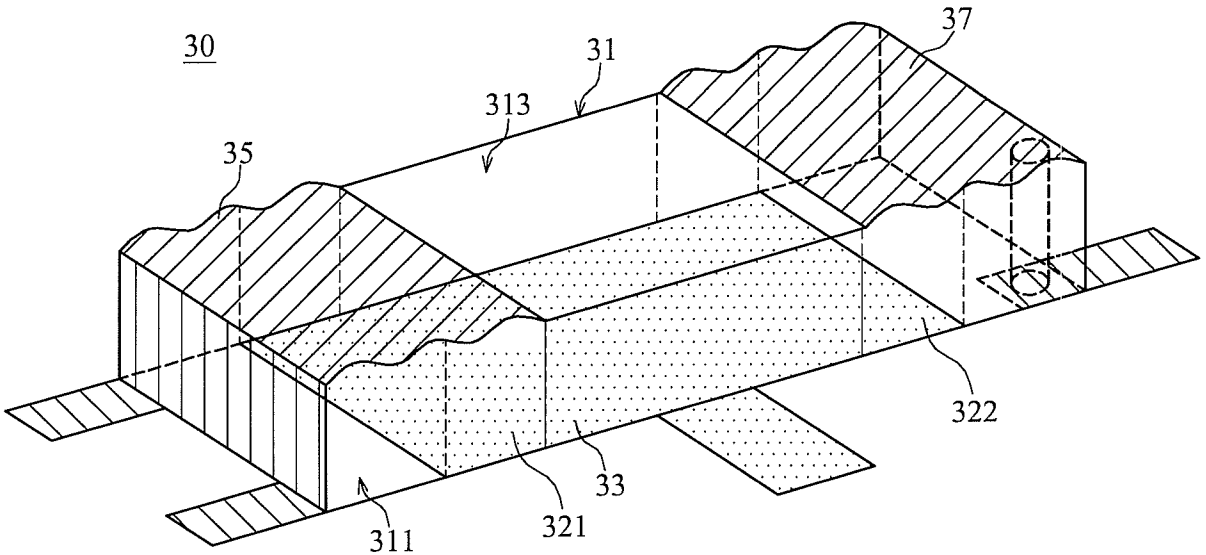
FIG. 8 is a perspective diagram of a miniature antenna according to a further embodiment of the present invention.

Referring to FIG. 8, there is shown a perspective diagram of a miniature antenna according to a further embodiment of the present invention. As illustrated in this figure, a miniature antenna 30 comprises a dielectric element 31, at least one first conductive plane 33, a second conductive plane 35 and a third conductive plane 37. In this connection, a part of a first surface 311 of the dielectric element 31 is provided with one or more first conductive planes 33, while a part of a second surface 313 of the dielectric element 31 is provided with a second conductive plane 35 and a third conductive plane 37.

In the present embodiment, the second conductive plane 35 and the third conductive plane 37 are presented as wavy structure. Moreover, a part of the first conductive plane 33 overlaps a part of the second conductive plane 35, so as to form a first overlap region 321, and a part of the first conductive plane 33 overlaps the third conductive plane 37, so as to form a second overlap region 322.

The distance between the first conductive plane 33 and the second conductive plane 35 as well as that between the first conductive plane 33 and the third conductive plane 37 may be finely tuned so as to adjust the resonant frequency of the miniature antenna 30, due to the wavy structure of the second conductive plane 35 and the third conductive plane 37. In different embodiments, certainly, it is also allowable for only one of the second conductive plane 35 and the third conductive plane 37 to be shaped as waves. Furthermore, the first conductive plane 33 may be also presented as wavy structure.

Figure 9:
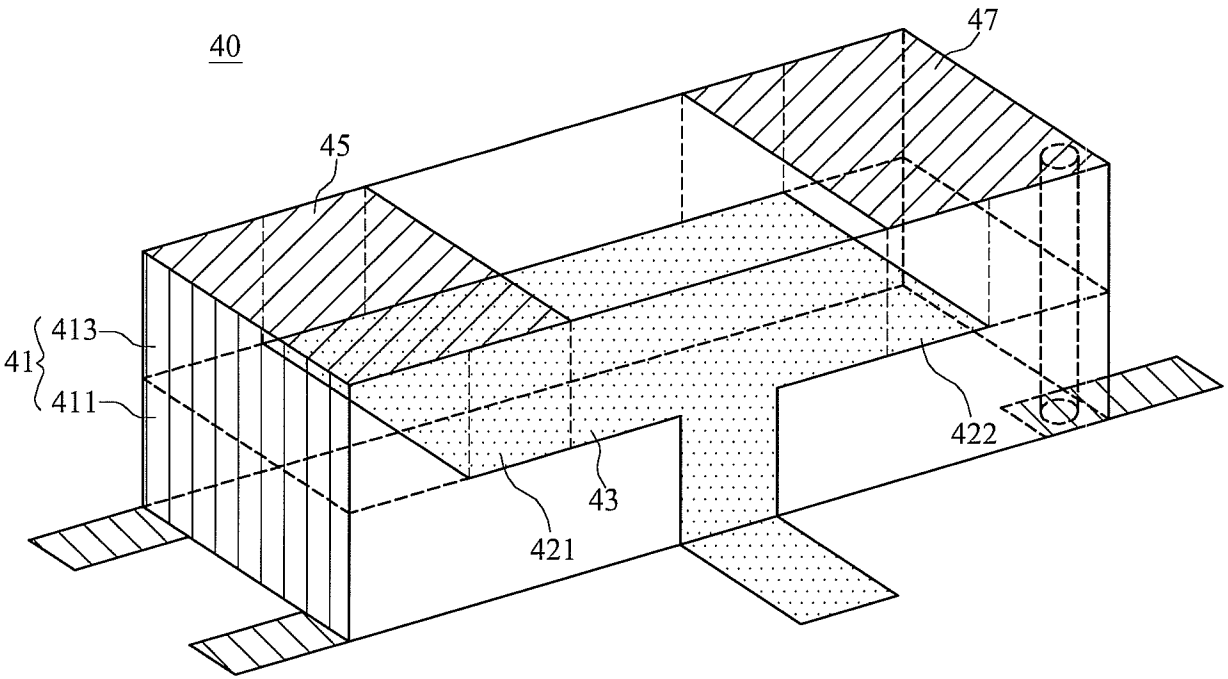
FIG. 9 is a perspective diagram of a miniature antenna according to a further embodiment of the present invention.

Referring to FIG. 9, there is shown a perspective diagram of a miniature antenna according to a further embodiment of the present invention. As illustrated in this figure, a miniature antenna 40 comprises a dielectric element 41, at least one first conductive plane 43, a second conductive plane 45 and a third conductive plane 47. In this embodiment, the dielectric element 41 comprises a first dielectric plane 411 and a second dielectric plane 413, with the former being stacked under the latter.

The first conductive plane 43 is provided between the first dielectric layer 411 and the second dielectric layer 413, while the second conductive plane 45 and the third conductive plane 47 are provided on a part of the top surface of the second dielectric layer 413. A part of the second conductive plane 45 overlaps a part of the first conductive plane 43, so as to form a first overlap region 421, and a part of the third conductive plane 47 overlaps a part of the first conductive plane 43, so as to form a second overlap region 422.

Figure 9A:
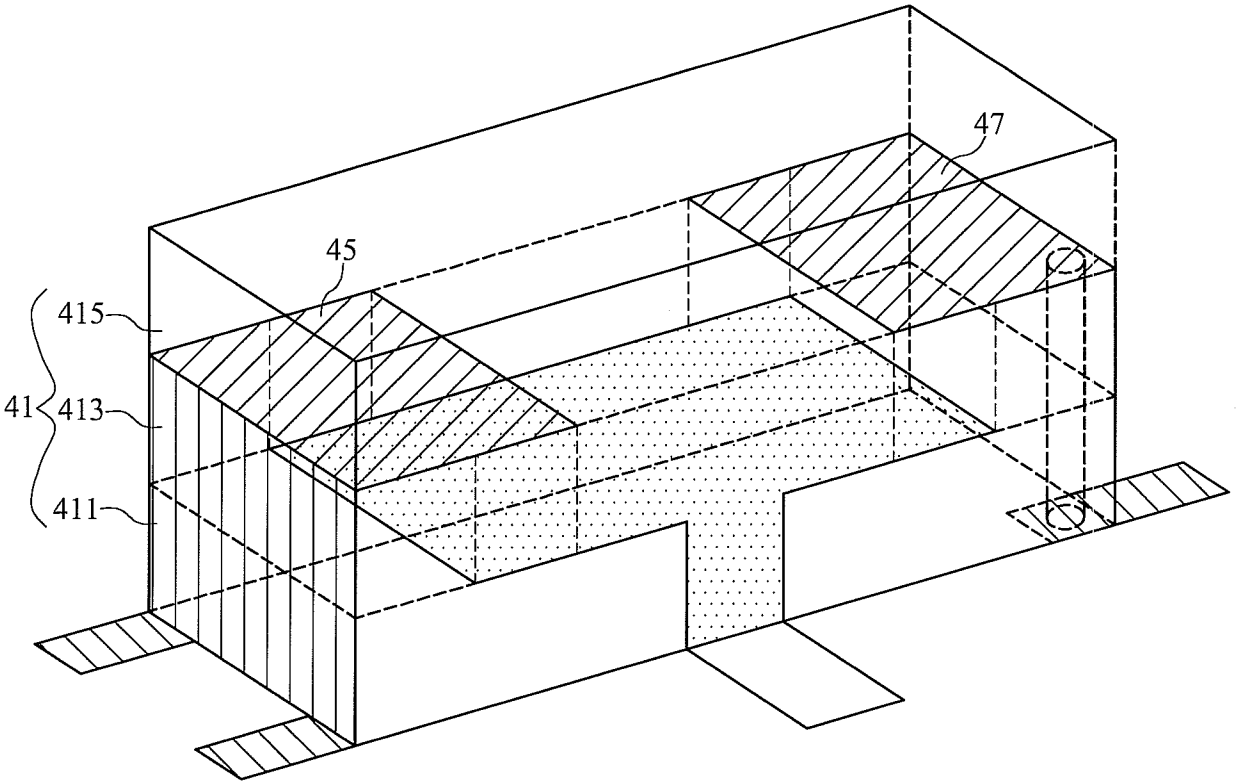
FIG. 9A is a perspective diagram of a miniature antenna according to a further embodiment of the present invention.

A third dielectric element 415 may be also stacked on the top surface of the second dielectric element 413, in such a way that the second conductive plane 45 and the third conductive plane 47 are located between the second dielectric element 413 and the third dielectric element 415, as illustrated in FIG. 9A.

Figure 10:
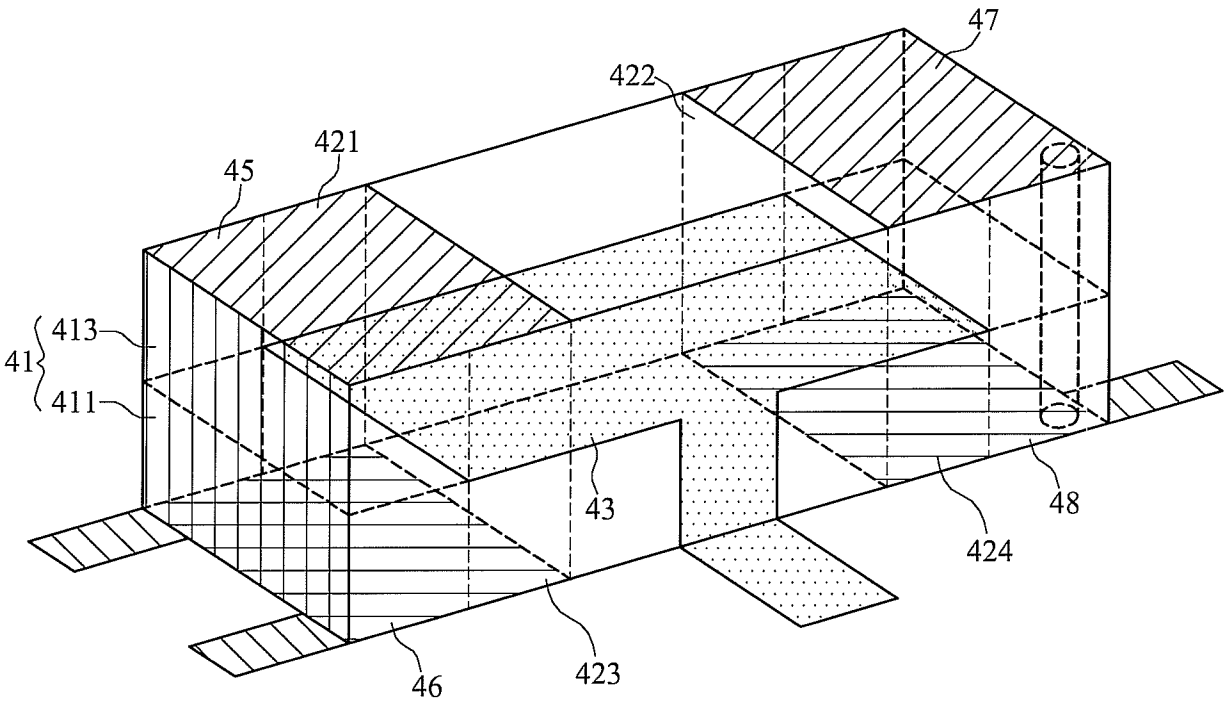
FIG. 10 is a perspective diagram of a miniature antenna according to a further embodiment of the present invention.

In different embodiments, as illustrated in FIG. 10, a fourth conductive plane 46 and a fifth conductive plane 48 are also further provided on a part of the bottom surface of the first dielectric layer 411. In this embodiment, a part of the fourth conductive plane 46 overlaps a part of the first conductive plane 43, so as to form a third overlap region 423, and a part of the fifth conductive plane 48 overlaps a part of the first conductive plane 43, so as to form a fourth overlap region 424. Additionally, the fourth conductive plane 46 and the fifth conductive plane 48 may also respectively overlap the second conductive plane 45 and the third conductive plane 47.

The fourth conductive plane 46 is connected to the ground terminal 143, while the fifth conductive plane 48 is connected to the ground terminal 143. Moreover, the dielectric element 41 further comprises a third dielectric layer 415 provided on top of the second dielectric layer 413 and a fourth dielectric layer provided under said first dielectric layer 411.

Figure 11:
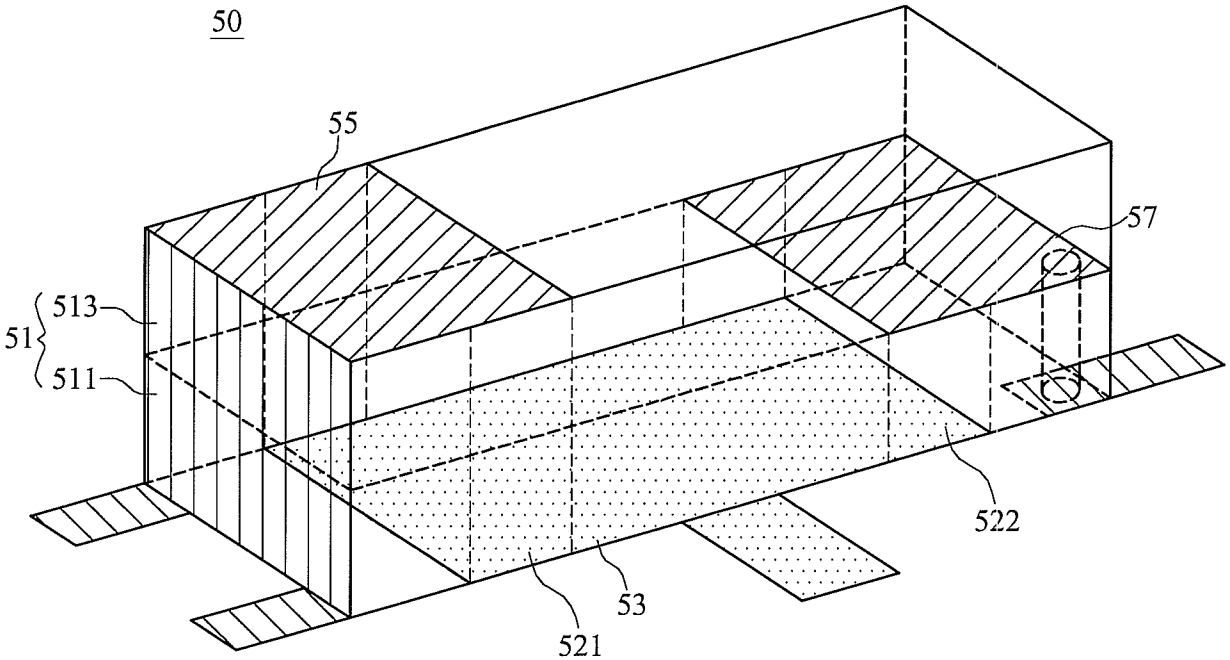
FIG. 11 is a perspective diagram of a miniature antenna according to a further embodiment of the present invention.

Referring to FIG. 11, there is shown a perspective diagram of a miniature antenna according to a further embodiment of the present invention. As illustrated in this figure, a miniature antenna 50 comprises a dielectric element 51, at least one first conductive plane 53, a second conductive plane 55 and a third conductive plane 57. In this embodiment, the dielectric element 51 comprises a first dielectric layer 511 and a second dielectric layer 513, with the second dielectric layer being stacked on top of first dielectric layer.

The first conductive plane 53 is provided on a part of the bottom surface of the first dielectric layer 511, while the second conductive plane 55 is provided on a part of the top surface of the second dielectric layer 513. Moreover, a part of the second conductive plane 55 overlaps a part of the first conductive plane 53, so as to form a first overlap region 521. Between the first dielectric layer 511 and the second dielectric layer 513, there is provided the third conductive plane 57, a part of which overlaps a part of the first conductive plane 53, so as to form the second overlap region 522. The distance between the first conductive plane 53 and the second conductive plane 55 is different from that between the first conductive plane 53 and the third conductive plane 57, due to different heights between the second conductive plane 55 and the third conductive plane 57, thus facilitating the adjustment of the resonant frequencies of the miniature antenna 50.

In another embodiment of the present invention, the first conductive plane 53 is provided between the first dielectric layer 511 and the second dielectric layer 513, the second conductive plane 55 is provided on the top surface of the second dielectric layer 513 and the third conductive plane 57 is provide on the bottom surface of the first dielectric layer 511.

In the embodiments of the present invention shown in above FIGS. 9, 10 and 11, two dielectric layers for each of the dielectric elements 41/51 are described for the miniature antennas 40/50 principally. In different embodiments, however, the number of the dielectric layers of the dielectric elements of the miniature antenna may be more than two. For instance, the third dielectric layer 415 illustrated in FIG. 9A may be further provided on the top surface of the second dielectric layer 413.

In the embodiments of the present invention shown in above FIGS. 7, 8, 9, 10 and 11, the terminal electrodes established on the lateral side surfaces of the dielectric element or the connection units 18 passing through the dielectric element are able to achieve the electrical connection of the conductive planes on different surfaces, the electrical connection of conductive planes and the ground terminals, or the electrical connection of conductive planes and the signal feeding terminals.

Therefore, the miniature antenna disclosed in the present invention can comprise a dielectric element which is formed by a plurality of dielectric layers as well as a plurality of first conductive planes, a plurality of second conductive planes and a plurality of third conductive planes. The plurality of dielectric layers are stacked on top of one another, with the first conductive planes, the second conductive planes and/or the third conductive planes being provided between any two adjacent dielectric layers of the dielectric elements or on the surface of any one of the dielectric layers of the dielectric elements. One or more first overlap regions are formed between the first conductive planes and the second conductive planes, while one or more second overlap regions are formed between the first conductive planes and the third conductive planes.

Each of the first conductive planes are electrically connected with one another, and connected to a ground terminals via first connection units; each of the second conductive planes are electrically connected with one another, and connected to a signal feeding terminal and the ground terminals via second connection units; and each of the third conductive planes are electrically connected with one another, and connected to the ground terminals via third connection units. The first connection units, the second connection units and the third connection units may pass through one or more of the dielectric layers of the dielectric elements 61. In different embodiments, certainly, the conductive planes may be provided on the outer surfaces of the dielectric element 61.

Figure 12:
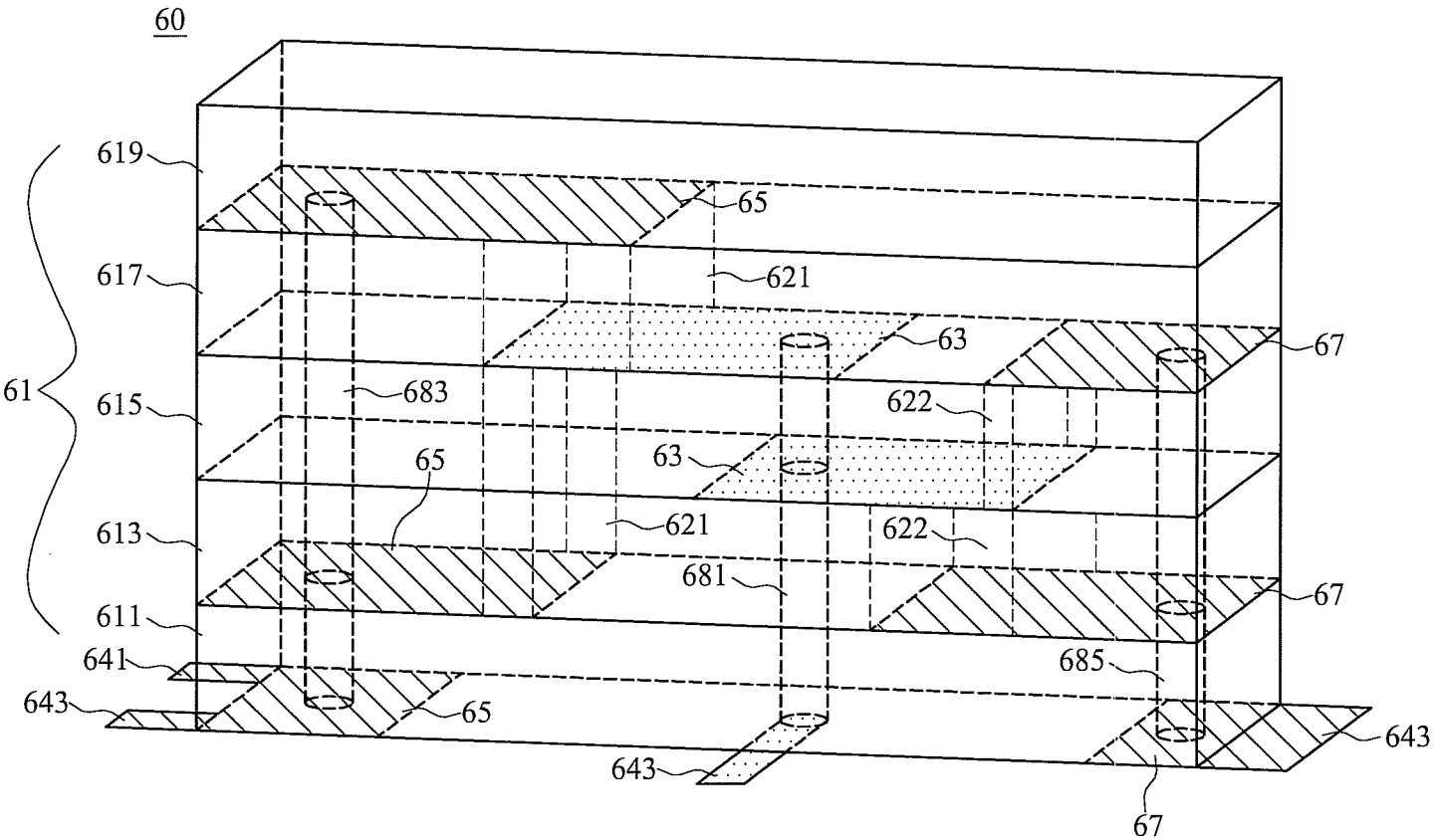
FIG. 12 is a perspective diagram of a miniature antenna according to a further embodiment of the present invention.

Referring to FIG. 12, there is shown a perspective diagram of a miniature antenna according to a further embodiment of the present invention. As illustrated in this figure, the dielectric element 61 comprises a first dielectric layer 611, a second dielectric layer 613, a third dielectric layer 615, a fourth dielectric layer 617 and a fifth dielectric layer 619, made of dielectric material of identical or different compositions, respectively. One first conductive plane 63 is provided between the second dielectric layer 613 and the third dielectric layer 615, while the other first conductive plane 63 is provided between the third dielectric plane 615 and the fourth dielectric plane 617. Moreover, the first connection unit 681 connecting with all the first conductive planes 63 may be further extended to the bottom surface of the first dielectric layer 611 and connects with ground terminal 643.

One second conductive plane 65 is provided between the first dielectric layer 611 and the second dielectric layer 613, while another second conductive plane 65 is provided between the fourth dielectric layer 617 and the fifth dielectric layer 619. Additionally, on the bottom surface of the first dielectric layer 611, there may be also provided the other second conductive plane 65. Two first overlap regions 621 are formed between the first conductive planes and second conductive planes. Connection unit 683 passes through dielectric layers between various second conductive planes to connect various second conductive planes and the signal feeding terminal 641 and the ground terminal 643.

One third conductive plane 67 is provided between the first dielectric layer 611 and the second dielectric layer 613, while another third conductive plane 67 is provided between the third dielectric layer 615 and the fourth dielectric layer 617. Additionally, on the bottom surface of the first dielectric layer 611, there may be also provided the other third conductive plane 67. Two second overlap regions 622 are formed between the first conductive planes and third conductive planes. Connection unit 685 passes through dielectric layers between various third conductive planes to connect various third conductive planes and the ground terminal 643.

The structure mentioned above is only one embodiment of the present invention. In practical use, the number of the dielectric layers in the dielectric element 61, the numbers of first conductive planes 63, second conductive planes 65 and third conductive planes 67, as well as the locations of the first conductive planes 63, second conductive planes 65 and third conductive planes 67 may be further changed.

Furthermore, a circuit board or printed circuit board (PCB) generally comprises a plurality of stacked dielectric layers or dielectric materials, each of the dielectric layers of the circuit board or the PCB may be used as the first dielectric layer 411/511/611, the second dielectric layer 413/513/613, the third dielectric layer 415/615, the fourth dielectric layer 617 and/or the fifth dielectric layer 619 of the miniature antenna 40/50/60. Thereby, the construction of the miniature antenna 40/50/60 may be integrated into the circuit board or PCB when the circuit board or PCB is designed or provided. Additionally, the dielectric element 11/21/31/41/51/61 described in each of above embodiments of the present invention may be presented as a rigid circuit board or a flexible circuit board.

The above embodiments are only used to illustrate the present invention, and are not intended to limit the scope thereof. Many modifications of the above embodiments can be made without departing from the spirit of the present invention.

The invention claimed is:

1. A miniature antenna, which is connected to at least one signal feeding terminal and at least one ground terminal and is used for transmitting and receiving wireless signals, comprising:

a dielectric element comprising a first surface and a second surface;

at least one first conductive plane provided on said first surface of said dielectric element;

at least one second conductive plane provided on a part of said second surface of said dielectric element, wherein a part of said second conductive plane overlaps a part of said first conductive plane, so as to form a first overlap region;

at least one third conductive plane provided on a part of said second surface of said dielectric element, wherein a part of said third conductive plane overlaps a part of said first conductive plane, so as to form a second overlap region;

a plurality of ground terminals connected with said first conductive plane and said third conductive plane, respectively; and a signal feeding terminal connected with said second conductive plane.

2. The miniature antenna of claim 1, wherein said first conductive plane, said second conductive plane and said third conductive plane are two-dimensional planar planes which are electrically conductive.

3. The miniature antenna of claim 1, wherein said second conductive plane is connected to said ground terminal.

4. The miniature antenna of claim 1, wherein said second conductive plane is connected to said ground terminal and said signal feeding terminal via at least one terminal electrode established on the lateral side of said dielectric element, while said third conductive plane is connected to said ground terminal via at least one terminal electrode established on the lateral side of said dielectric element.

5. The miniature antenna of claim 1, wherein said second conductive plane is connected to said ground terminal and said signal feeding terminal via at least one connection unit passing through said dielectric element, while said third conductive plane is connected to said ground terminal via at least one connection unit passing through said dielectric element.

6. The miniature antenna of claim 1, wherein said dielectric element comprises a first dielectric layer and a second dielectric layer, and said first dielectric layer is stacked under said second dielectric layer.

7. The miniature antenna of claim 6, wherein said first conductive plane is provided on the bottom surface of said first dielectric layer, said second conductive plane is provided on the top surface of said second dielectric layer, and said third conductive plane is provided between said first dielectric layer and said second dielectric layer.

8. The miniature antenna of claim 6, wherein said first conductive plane is provided between said first dielectric layer and said second dielectric layer, as well as said second conductive plane and said third conductive plane are provided on the top surface of said second dielectric layer.

9. The miniature antenna of claim 6, wherein said first conductive plane is provided between said first dielectric layer and said second dielectric layer; said second conductive plane is provided on the top surface of said second dielectric layer and said third conductive plane is provided on the bottom surface of said first dielectric layer.

10. The miniature antenna of claim 8, further comprising a fourth conductive plane and a fifth conductive plane provided on the bottom surface of said first dielectric layer, wherein a part of said fourth conductive plane overlaps a part of said first conductive plane, so as to form a third overlap region, while a part of said fifth conductive plane overlaps a part of said first conductive plane, so as to form a fourth overlap region.

11. The miniature antenna of claim 10, wherein said fourth conductive plane is electrically connected with said second conductive plane via at least one terminal electrode established on the lateral side of said dielectric element or via at least one connection unit passing through said dielectric element and said fifth conductive plane is electrically connected with said third conductive plane via at least one terminal electrode established on the lateral side of said dielectric element or via at least one connection unit passing through said dielectric element, respectively.

12. The miniature antenna of claim 10, wherein said dielectric element further comprises a third dielectric layer provided on top of said second dielectric layer and a fourth dielectric layer provided under said first dielectric layer.

13. The miniature antenna of claim 1, wherein said first conductive plane, said second conductive plane or said third conductive plane comprises at least one meandering pattern, or at least one protruded part.

14. The miniature antenna of claim 1 comprises at least two resonant frequencies tuned or adjusted by modifying the antenna structure of said miniature antenna.

15. The miniature antenna of claim 1, wherein said miniature antenna is installed on the surface of a circuit board for transmitting and receiving of wireless signals, and said circuit board is provided with a clearance region around said miniature antenna, wherein clearance region is a region with no electric circuitry or electrical components.

16. The miniature antenna of claim 1, wherein said miniature antenna is built directly within a circuit board, and the substrate material or substrate of said circuit board is used as said dielectric element of said miniature antenna.

17. The miniature antenna of claim 1, wherein said first conductive plane, said second conductive plane, or said third conductive plane is presented as wavy structure.

18. The miniature antenna of claim 1, further comprising a floating plane, which is an electrically conductive plane without connecting to said signal feeding terminal or said ground terminal, wherein said floating plane is provided between said second conductive plane and said third conductive plane on said second surface, and overlaps a part of said first conductive plane.

19. A miniature antenna which is connected to at least one signal feeding terminal and at least one ground terminal and is used for transmitting and receiving wireless signals, comprising:

a circuit board; and a miniature antenna provided within said circuit board or on the surfaces of said circuit board, wherein said miniature antenna comprises:

a dielectric element comprising a first surface and a second surface, wherein said dielectric element is part of said circuit board with thickness equals or less than said circuit board;

at least one first conductive plane provided on said first surface of said dielectric element;

a second conductive plane provided on a part of said second surface of said dielectric element, wherein said second conductive plane overlaps said first conductive plane, so as to form a first overlap region;

at least one third conductive plane provided on a part of said second surface of said dielectric element, wherein said third conductive plane overlaps said first conductive plane, so as to form a second overlap region;

a plurality of ground terminals respectively connected with said first conductive plane, and said third conductive plane; and a signal feeding terminal connected with said second conductive plane.

20. The miniature antenna of claim 19, wherein said first conductive plane, said second conductive plane, and said third conductive plane are two-dimensional planar planes which are electrically conductive.

21. The miniature antenna of claim 19, wherein said second conductive plane is connected to said ground terminal.

22. The miniature antenna of claim 19, wherein said miniature antenna comprises at least two resonant frequencies, and said resonant frequencies tuned or adjusted by modifying the antenna structure of said miniature antenna.

23. The miniature antenna of claim 19, wherein said second conductive plane is connected to said grounding terminal and said signal feeding terminal via at least one connection unit passing through said dielectric element, while said third conductive plane is connected to said ground terminal via at least one connection unit passing through said dielectric element.

24. The miniature antenna of claim 19, further comprises a floating plane, which is a electrically conductive plane without connecting to said signal feeding terminal or said ground terminal, wherein said floating plane is provided between said second conductive plane and said third conductive plane on said second surface, and overlaps a part of said first conductive plane.

25. A miniature antenna, which is connected to at least one signal feeding terminal and at least one ground terminal and is used for transmitting and receiving wireless signals, comprising:

a dielectric element comprising a plurality of dielectric layers stacked together;

at least one first conductive plane provided between any two adjacent dielectric layers of said dielectric element or on the surfaces of any one of said dielectric layers;

at least one second conductive plane provided between any two adjacent dielectric layers of said dielectric element or on the surfaces of any one of said dielectric layers;

at least one third conductive plane provided between any two adjacent dielectric layers of said dielectric element or on the surfaces of any one of said dielectric layers;

a plurality of ground terminals connected with said first conductive plane, and said third conductive plane, respectively; and a signal feeding terminal connected with said second conductive plane, wherein part of said first conductive planes overlap part of said second conductive planes, so as to form at least one first overlap regions, while part of said first conductive planes overlap part of said third conductive planes, so as to form at least one second overlap regions.

26. The miniature antenna of claim 25, wherein said first conductive plane, said second conductive plane, and said third conductive plane are two-dimensional planar planes which are electrically conductive.

27. The miniature antenna of claim 25, wherein said second conductive planes are connected to said ground terminal.

28. The miniature antenna of claim 25, wherein said miniature antenna is built directly within a circuit board, and the substrate material or substrates of said circuit board is used as said dielectric element of said miniature antenna.

29. The miniature antenna of claim 25, further comprising at least one first connection unit, used for connecting each of said first conductive planes with one another, and to one of said ground terminals; at least one second connection unit, used for connecting each of said second conductive planes with one another, and to said signal feeding terminal; and at least one third connection unit, used for connecting each of said third conductive planes with one another, and to one of said ground terminals, wherein said first connection units, said second connection units and said third connection units are established on the lateral sides of said dielectric element or established within said dielectric element and pass through one or more of said dielectric layers.

30. The miniature antenna of claim 25, wherein said miniature antenna comprise at least two resonant frequencies tuned or adjusted by modifying the antenna structure of said miniature antenna.

31. A miniature antenna, which is connected to at least one signal feeding terminal and at least one ground terminal and is used for transmitting and receiving wireless signals, comprising:

a dielectric element comprising a first surface and a second surface;

at least one first conductive plane provided on said first surface of said dielectric element;

at least one second conductive plane provided on a part of said second surface of said dielectric element, wherein a part of said second conductive plane overlaps a part of said first conductive plane, so as to form a first overlap region;

at least one third conductive plane provided on a part of said second surface of said dielectric element, wherein a part of said third conductive plane overlaps a part of said first conductive plane, so as to form a second overlap region;

a plurality of ground terminals connected with said second conductive plane and said third conductive plane, respectively; and a signal feeding terminal connected with said first conductive plane.

32. The miniature antenna of claim 31, wherein said first conductive plane is connected to said ground terminal.

33. The miniature antenna of claim 31, wherein said second conductive plane is connected to said ground terminal via at least one terminal electrode established on the lateral side of the said dielectric element, while said third conductive plane is connected to said ground terminal via at least one terminal electrode established on the lateral side of the said dielectric element.

34. The miniature antenna of claim 31, wherein said second conductive plane is connected to said ground terminal via at least one connection unit passing through said dielectric element, while said third conductive plane is connected to said ground terminal via at least one connection unit passing through said dielectric element.

35. The miniature antenna of claim 31, wherein said dielectric element comprises a first dielectric layer and a second dielectric layer, and said first dielectric layer is stacked under said second dielectric layer.

36. The miniature antenna of claim 35, wherein said first conductive plane is provided on the bottom surface of said first dielectric layer, said second conductive plane is provided on the top surface of said second dielectric layer, and said third conductive plane is provided between said first dielectric layer and said second dielectric layer.

37. The miniature antenna of claim 35, wherein said first conductive plane is provided between said first dielectric layer and said second dielectric layer, said second conductive plane is provided on the top surface of said second dielectric layer and said third conductive plane is provide on the bottom surface of said first dielectric layer.

38. The miniature antenna of claim 35, wherein said first conductive plane is provided between said first dielectric layer and said second dielectric layer; said second conductive plane and said third conductive plane are provide on the top surface of said second dielectric layer.

39. The miniature antenna of claim 38, further comprising a fourth conductive plane and a fifth conductive plane provided on the bottom surface of said first dielectric layer, wherein said fourth conductive plane is connected to said ground terminal and a part of said fourth conductive plane overlaps a part of said first conductive plane so as to form a third overlap region, while said fifth conductive plane is connected to said ground terminal and a part of said fifth conductive plane overlaps a part of said first conductive plane so as to form a fourth overlap region.

40. The miniature antenna of claim 39, wherein said dielectric element further comprises a third dielectric layer provided on top of said second dielectric layer and a fourth dielectric layer provided under said first dielectric layer.

* * * * *